United States Patent [19]

Ramnesten

[11] 4,429,561

[45] Feb. 7, 1984

[54] MANDREL FOR COLD FORGING INTERNALLY PROFILED TUBES OR CYLINDERS

[75] Inventor: Ivan O. Ramnesten, Eskilstuna, Sweden

[73] Assignee: Forenade Fabriksverken, Eskilstuna, Sweden

[21] Appl. No.: 341,666

[22] Filed: Jan. 22, 1982

[30] Foreign Application Priority Data

Feb. 3, 1981 [SE] Sweden ..... 8100772

[51] Int. Cl.[3] ..... B21J 13/02

[52] U.S. Cl. ..... 72/478; 72/370; 72/208; 72/401; 72/398; 10/152 R

[58] Field of Search ..... 72/76, 370, 402, 398, 72/401, 139, 208, 343, 478; 10/152 R

[56] References Cited

U.S. PATENT DOCUMENTS 4,154,082 5/1979 Beech ..... 72/401

FOREIGN PATENT DOCUMENTS 13943 6/1855 France ..... 72/139

*Primary Examiner*—Daniel C. Crane
*Assistant Examiner*—David B. Jones
*Attorney, Agent, or Firm*—James E. Nilles

[57] ABSTRACT

A mandrel for the production of internally profiled, specially threaded tubes or cylinders (2) by the cold forging of tube shaped forging blank (2) around a profiled mandrel (3) by cold forging the workpiece (2) from its one end to the opposite end. The threaded mandrel is parted at or near its axial center and both halves (3*a*, 3*b*) are held together axially free under a given radial play. Both ends (8, 13) of the mandrel halves are shaped for the application of a spanner. The mandrel halves can be shaped slightly conical from the ends in towards the parting line, and the flanks of the mandrel threads (14, 15) can be ground so that the threads thicken slightly and continously from the parting line and outwardly towards the mandrel's ends. The thread depth in the mandrel can be slightly deeper than the required thread height on the cold forged tube or product.

4 Claims, 4 Drawing Figures

MANDREL FOR COLD FORGING INTERNALLY PROFILED TUBES OR CYLINDERS

BACKGROUND OF THE INVENTION

The present invention concerns the cold forging or cold hammering of objects of steel or other metals, and the invention concerns more specially a mandrel for the cold forging of profiled tubes or cylinders etc. Profiled means in this case any profiled form such as axial grooves or splines, various kinds of threads, threads combined with axial grooves etc.

Internal profiles in tubes or cylinders have earlier been produced by cutting methods such as turning, shaping, slotting etc. The production of internal profiles in tubes and cylinders etc. has of late even been accomplished by cold forging, whereby a tube or cylinder is forged around a mandrel, which after the process is removed from the tube or cylinder.

Cold forging involves several advantages compared to cutting methods. By cold forging a finer surface finish can be achieved than with cutting methods, the material is harder as a result of the fact that no material fibers are cut off, internal stresses from earlier handling are eliminated, the profiles can be formed to extremely fine tolerances, the cold forged products are produced with an even and high quality etc.

Cold forging around a mandrel however does present some problems. As cold forging is normally effected by a successive working of a tube or cylinder from one end to the other by using forging hammers, the workpiece will during forging be worked with great force into the mandrel's grooves, pits or such-like, so that the mandrel and workpiece are forced into very close contact with each other. By hammer working the workpiece from one end to the other, the workpiece will lengthen in a direction which is the same as the forging hammers' direction of movement along the workpiece. This leads to the rise of great axial forces between the workpiece and the mandrel. This in turn leads to problems which can arise when removing the mandrel from the final product.

When forming axial grooves, the mandrel must be removed axially from the forged product, and when forming internal threads or other spiral formations, the mandrel must be removed from the product by a screwing motion. Special problems arise in case where the workpiece, apart from axial grooves or threads, is also formed with a circular or purely radial rib. This occurs for example with joining sleeves etc. where a rib ensures that rods, for example drilling rods, cannot be pushed or screwed in further than to a given position in the tube or sleeve. In this case the mandrel obviously cannot be screwed or drawn out of the sleeve and therefore the production of such sleeves has not earlier been possible by cold forging in only one working step.

The present invention intends to eliminate the said problem and to provide a mandrel for the production of internally profiled tubes or cylinders, which allows a relatively simple removal of the mandrel from the final forged product and which even makes it possible in only one working step, to produce an internal profile comprising a circular or purely radial rib in the cylinder.

SUMMARY OF THE INVENTION

According to the invention, the mandrel is parted in the axial direction at or near the mandrel's axial centre or at a circumferential groove. Parting the mandrel leads to the possibility of removing it from the product by using considerably less force than before and particularly by parting the mandrel at the circumferential groove makes it possible to draw or screw out the mandrel without its removal being obstructed by the formed circumferential rib in the cylinder.

A particularly simple and advantageous form is to be gained if the mandrel's grooves, threads or such-like are shaped to be somewhat conically diverging towards the mandrel's parting line, whereby when drawing or screwing out the mandrel halves a total release is achieved by only a little movement between the mandrel and cylinder.

A suitable shaping of the mandrel is also such that the grooves or pits are somewhat deeper than the thread tops of the product so that the thread or profile tops are not forced into the bottom of the mandrel's grooves or pits.

When producing internal threads, the mandrel can preferably even be ground with successively slightly narrowing thread flanks in a direction towards the parting line, so that even threads provide an effective release after only a very little screwing out of the mandrel from the forged product.

A detailed description of the invention will be evident from the following wherein references will be made to the accompanying drawings. However it must be understood that the embodiment of the invention described and shown on the drawings only encompasses one illustrated example and various kinds of modifications can be envisaged within the scope of the patent claims.

DESCRIPTION OF THE DRAWINGS

The drawings show in FIG. 1 diagrammatically parts of a machine or tool for the cold forging of an internally threaded sleeve with a central circular rib.

DESCRIPTION OF THE INVENTION

Figure 1:
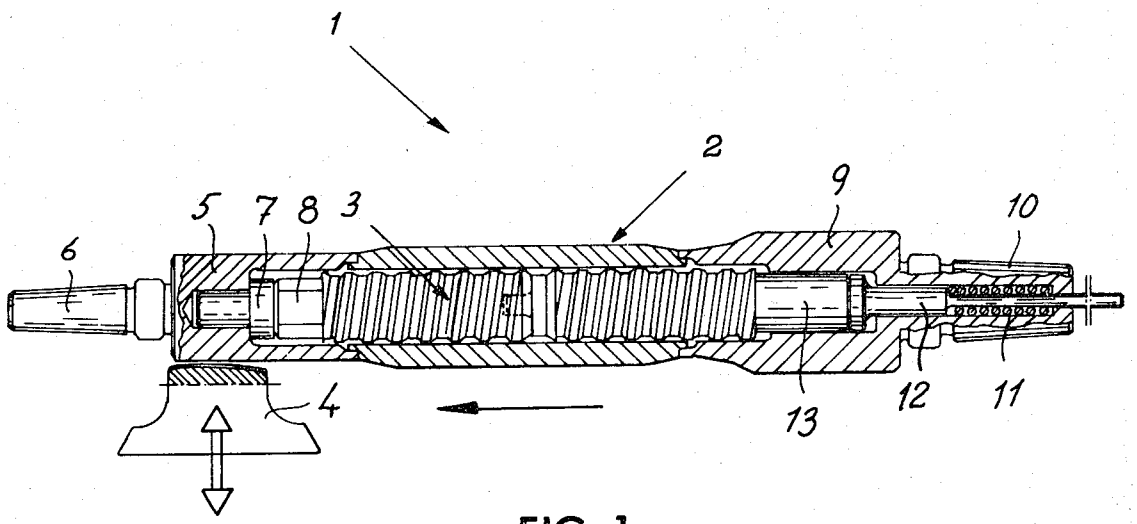

The machine shown in FIG. 1 for the cold forging or cold hammering of internal profiles in a cylindrical workpiece comprises generally a forging tool 1, in which a forging blank 2 and a mandrel 3 can be set up. The forging tool 1 is arranged to be rotated, and at one end a number of hammers 4 are positioned around the tool, of which only one is shown on the drawing. The hammers can be driven by eccentrics so that they continuously hammer over the workpiece 2, which is displaceable in the tool past the hammers 4. During displacement the forging blank is hammered so that its inside is shaped according to the mandrel's form while its outside is formed with an even surface.

The tool 1 has at one end an end socket 5 with a journal 6, which is supported in a ball bearing, not shown. The inside of the end socket 5 is formed with an axial hole, in which a replaceable end positioner 7 for the one end portion 8 of the mandrel 3 is mounted. The end positioner 7 is preferably replaceable so that the mandrel's 3 axial position in relation to the workpiece 2 can be adjusted. At the other end the tool 1 comprises a driver 9 with a shaft end 10 arranged to be coupled to a device, not shown to rotate the tool together with the workpiece and mandrel while the hammers 4 work the workpiece. At this end of the mandrel, a spring 11 loaded ram 12 forces the end 13 of the mandrel 3 against the end positioner 7. The end socket 5 is axially fixed but rotatable, while the driver 9 is axially movable and loads the workpiece 2 with a pre-determined force towards the end socket 5. During forging the workpiece lengthens and during this extension the driver 9 is displaced while the spring loaded ram holds the mandrel pressed against the end positioner 7 in the end socket 5.

Figure 2:
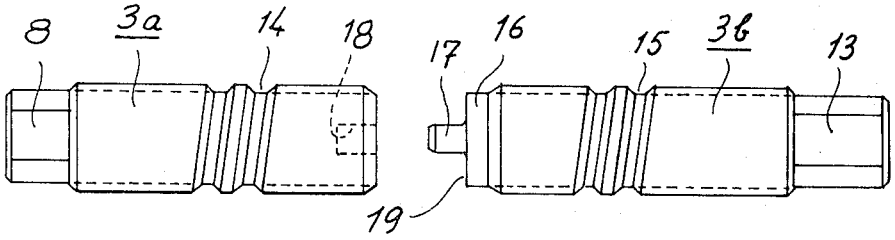
FIG. 2 shows a mandrel according to the invention for use in connection with the apparatus in FIG. 1.

FIG. 2 shows a mandrel according to the invention, which in this case is shaped for the production of a joining sleeve for rods, for example drilling rods. For this purpose the mandrel is shaped with threads 14, 15 which from each end of the mandrel run towards a middle position, and the mandrel's centre is formed with a circumferential groove 16, which is intended to form a circumferential rib in the joining sleeve, which ensures that none of the drilling rod can be screwed in further than to the joining sleeve's middle. According to the invention the mandrel is parted into two halves 3*a*, 3*b*, and each end 8, 13 is shaped hexagonal for the application of a spanner.

A mandrel with a continual thread is parted preferably at or close to the mandrel's axial centre, and as the mandrel is parted into two halves it can be removed from the product by withdrawing from both ends. Both the halves 3*a* and 3*b* can be linked to each other with the aid of a dowel 17 in the one mandrel half, which inserts in a hole 18 in the other mandrel half. The dowel and hole must freely connect each other to ensure that the halves of the mandrel can be taken apart and preferably the dowel and hole should be given some play so as not to impede any eventual radial movement between the halves during forging.

In the shown case, where the mandrel is shaped with a circular groove 16, the mandrel is parted at one side of the groove.

The mandrel's threads are most suitably formed slightly conically inwards towards the parting line 19 and similarly the thread flanks on the threads 14, 15 are ground so that they successively narrow from the mandrel's ends in towards the parting line. The threads are thus thinnest at the parting line and thicken evenly out towards the mandrel's ends. By each of these measures both the halves of the mandrel are given a certain release capability so that the mandrel can easily be removed from the product with only a little relative movement between the mandrel half and product, as this movement creates an immediate play between the mandrel and product.

Figure 3:
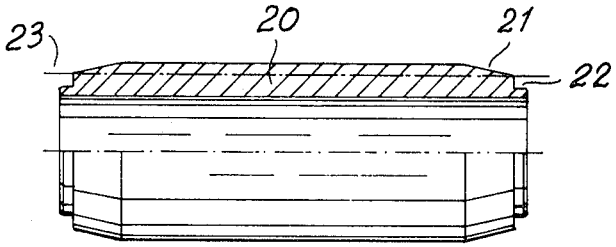
FIG. 3 shows a workpiece for forging to a joining sleeve for drilling rods. The figure is partly cut away.
Figure 4:
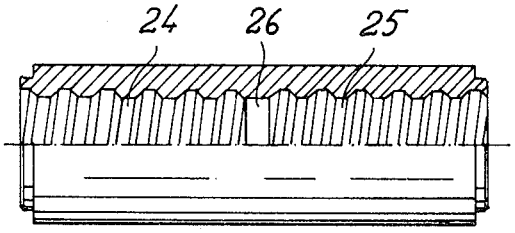
FIG. 4 shows in a similar way the workpiece in FIG. 3 after being forged around the mandrel.

FIG. 3 shows a forging blank for cold forging to be formed into a joining sleeve, around a mandrel as in FIG. 2. The forging blank is usually of steel and forms a tube 20 with coned ends 21 and attachment rings 22 for the end socket 5 and driver 9 respectively. When cold forging, a material displacement occurs so that the material outside the dotted line 23 is hammered radially inwards and an equal amount of material is pressed into the mandrel's thread groves 14, 15 respectively and the circumferential groove 16. The coned ends 21 give a correspondingly coned inlet to the threads which simplifies screwing in the drilling rods. After forging and removal of the mandrel halves out of the product the attachment rings 22 if required can be removed. As is shown in FIG. 4, the joining sleeve is threaded from both ends 24, 25 and has a central circumferential rib 26 which forms a barrier for screwing the threaded rods into the joining sleeve.

As is stated above the thread grooves 14 and 15 in the mandrel halves are formed with a depth which is somewhat larger than the required height of the threads 24, 25 in the joining sleeve, so that the thread tops in the joining sleeve are not pressed to the bottom of the mandrel's grooves. A difference of one or a few tenths of a millimeter are quite sufficient to enable the mandrel to be easily removed from the joining sleeve.

What is claimed is:

1. A mandrel receivable in a tubular cold forging blank for cooperation with forging hammers which repeatedly radially inwardly impact against the exterior of the blank, all around it and along its length, to form the blank into a substantially tubular product that has an internal radially inwardly projecting circumferential rib intermediate its ends and has an internal thread that extends axially from one of its ends to said rib, said mandrel being characterized by:

A. said mandrel having a concentric reduced diameter portion intermediate its ends that defines a circumferential groove in the mandrel whereby said rib is formed;

B. said mandrel comprising two axially separable parts which abuttingly engage one another at said reduced diameter portion thereof to be removable from the product in axially opposite directions;

C. One of said parts of the mandrel having an external thread which defines said internal thread and which extends along that mandrel part from said reduced diameter portion of the mandrel; and D. said one mandrel part, along the length of said external thread thereon, being of taperingly decreasing diameter in the direction towards said reduced diameter portion, to be readily removable from the product by rotation relative to it.

2. The mandrel of claim 1, further characterized by: one of said mandrel parts having, at its end adjacent to the other one, a coaxial, axially projecting dowel pin which is receivable with a small play in a coaxial hole in the adjacent end of said other mandrel part, to separably connect the mandrel parts and maintain them substantially coaxial.

3. The mandrel of claim 1 wherein said other mandrel part has an external thread which extends along its length from said reduced diameter portion of the mandrel and which defines another internal thread in the product that extends from said rib to the other end of the product, further characterized by:

each said mandrel part having a noncircular end portion which is remote from the other mandrel part and which is engageable by a spanner for rotationally loosening the mandrel part from the product.

4. The mandrel of claim 1, further characterized by: said external thread being of slightly but constantly increasing thickness, with respect to the distance between its flanks, in the direction away from said reduced diameter portion of the mandrel, to facilitate rotational removal of said mandrel part from the product.

* * * * *